US007303329B1

(12) United States Patent
Flynn

(10) Patent No.: US 7,303,329 B1
(45) Date of Patent: Dec. 4, 2007

(54) MIXING ROD WITH U-SHAPED MEMBER

(76) Inventor: Kevin B. Flynn, 675 Bradley St., East Haven, CT (US) 06512

( * ) Notice: Subject to any disclaimer, the term of this patent is extended or adjusted under 35 U.S.C. 154(b) by 0 days.

(21) Appl. No.: 11/551,617

(22) Filed: Oct. 20, 2006

(51) Int. Cl.
*B01F 7/32* (2006.01)

(52) U.S. Cl. ..... 366/129; 366/343; 366/605

(58) Field of Classification Search ..... 366/129, 366/342, 343, 605, 248; 99/348; 15/141.1; 416/69, 70 R; D7/300.2, 376, 688; D8/70
See application file for complete search history.

(56) References Cited

U.S. PATENT DOCUMENTS

| | | | | | |
|---|---|---|---|---|---|
| 1,248,153 | A | * | 11/1917 | Offenhauser | 416/163 |
| 2,490,015 | A | * | 12/1949 | Carman | 426/238 |
| 3,411,756 | A | * | 11/1968 | Ziegler | 366/251 |
| 3,704,007 | A | * | 11/1972 | Kroeger | 366/248 |
| 3,761,026 | A | | 9/1973 | Rohmer | |
| 4,054,272 | A | * | 10/1977 | Cooke | 366/343 |
| 4,057,226 | A | * | 11/1977 | de Mos et al. | 366/244 |
| 4,260,267 | A | * | 4/1981 | Walton | 366/343 |
| 4,422,770 | A | * | 12/1983 | Geible | 366/248 |
| 4,761,076 | A | | 8/1988 | Witcombe | |
| 4,763,567 | A | * | 8/1988 | Dalquist et al. | 99/323.5 |
| D316,100 | S | | 4/1991 | Kief | |
| 5,403,091 | A | * | 4/1995 | Thomas | 366/279 |
| 5,417,493 | A | * | 5/1995 | Ericson | 366/343 |
| 5,894,095 | A | | 4/1999 | DeMali | |
| D440,476 | S | * | 4/2001 | Del Gaone | D8/70 |
| 6,863,430 | B2 | * | 3/2005 | Berube | 366/129 |

FOREIGN PATENT DOCUMENTS

| | | | |
|---|---|---|---|
| DE | 3117459 | A1 * | 11/1982 |
| GB | 2094167 | A * | 9/1982 |
| GB | 2257638 | A * | 1/1993 |

* cited by examiner

*Primary Examiner*—Charles E. Cooley
(74) *Attorney, Agent, or Firm*—Advantia Law Group; Michael W. Starkweather; Jason P. Webb

(57) ABSTRACT

A mixing device for mixing resins and other liquids. The device comprises of a first elongated member which includes a drill end being adaptable to a conventional drill motor chuck and first connection end. A U-shaped member coupled to the first elongated member, which includes a first end coupled to the first connection end and a second end wherein the U-shaped member curves greater than about 180 degrees. A second elongated member is coupled to the U-shaped member and includes a second connection end coupled to the second end and a free end portion. The free portion extends adjacent to and substantially parallel to the first elongated member. The mixing device may also comprise one, contiguous single member. The mixing device may also be made of a rigid material including steel, ceramic, plastic, or the like.

11 Claims, 3 Drawing Sheets

MIXING ROD WITH U-SHAPED MEMBER

BACKGROUND OF THE INVENTION

1. Field of the Invention

The present invention relates to mixing devices, specifically mixing devices for resins, paints, and other liquids.

2. Description of the Related Art

In the related art, it has been known to use mixing devices of various sizes and shapes for mixing and stirring resins, paints and other liquids. Mixing devices have varied depending on the types of liquids being mixed, the varying degrees of liquids' viscosity and the type of containers in which the liquids are housed. Previously there have been problems with the inability of mixing devices to quickly and uniformly mix liquids. Mixing devices have also been unable to mix liquids of varying degrees of viscosity. Some improvements have been made in the field. Examples include but are not limited to the references described below, which references are incorporated by reference herein:

U.S. Pat. No. 5,417,493, issued to Ericson, discloses a new mixing device for joint compound and the like for mixing pre-blended and newly blended viscous liquid compounds within a cylindrical flat-bottomed container to obtain homogeneous consistency of the compound. The mixing device for joint compound and the like comprises a paddle member adapted to be rotatively driven by a conventional drill motor. The paddle member comprises a unitarily formed, essentially rigid rod having an elongated vertical shank portion with a collinearly formed chuck engagable portion on the proximal end thereof. An agitator blade portion is formed on the distal end of the shank portion. The agitator blade portion includes vertical and horizontal rod portions for efficient mixing of compound near the container sides and bottom. Angled rod portions are also included for efficient mixing of compound in the central area of the container.

U.S. Pat. No. 4,422,770, issued to Geible, discloses an electric drill powered paint stirrer for stirring paint in a conventional paint marketing can of the kind normally closed for sale by a lid. A second lid is substitutable on the can for the marketing lid and has a central opening. A stirring rod assembly is releasably securable in the second lid. The assembly comprises a bushing element having a reduced diameter externally threaded and extending from a shoulder. The bushing has a central through bore. The second lid opening is of diameter to snugly receive the threaded bushing end therethrough but not the shoulder. The assembly further includes a stirring rod having an upstanding shank extending upward through the bushing. The rod has upper and lower radially widened portions closely flanking the upper and lower ends of the bushing for axially locating the shank in the bushing. The rod has a bottom portion depending from the shank and sized to lie close to the can peripheral wall and bottom for stirring paint in the marketing can. A nut is threadable on the threaded bushing end to clamp the second lid against the shoulder of the bushing.

U.S. Pat. No. 3,761,026, issued to Rohmer, discloses a mixing and grinding apparatus comprising a bucket-like container having a centrally positioned, elongate, spindle-rod extending from the container base axially into the container cavity, and a cutting blade assembly defining an elongate, tubular shaft having a transverse cutting blade affixed thereto, the internal diameter of the tubular shaft larger than the diameter of the spindle-rod to be receivable thereover for rotation therearound. Rotative power for driving the cutting blade assembly is provided by a standard electric drill. The spindle-rod acts as a guide for the cutting blade assembly during rotation, insuring the maintenance of its axial alignment in the container as it is longitudinally displaced during mixing and grinding.

U.S. Pat. No. 4,761,076, issued to Witcombe, discloses a mixer especially suitable for small batches of cementitious product comprising a receptacle and means for mounting a motor drivable paddle arrangement within the receptacle in such a manner that the paddle, while operating, can be moved manually to sweep substantially the entire volume of said receptacle. In preferred arrangement the paddle arrangement is powered by a portable electric drilling machine.

U.S. Design Pat. No. D316,100, issued to Kief, discloses an ornamental design for a power-driven stirrer for drywall compound, paint, or the like.

The inventions heretofore known suffer from a number of disadvantages which include: mixing devices that use multiple parts and/or complicated configurations, large and/or bulky mixing devices which may limit the types and/or sizes of liquid containers used, and/or mixing device which are difficult and/or costly to manufacture.

What is needed is a mixing device that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available mixing devices. Accordingly, the present invention has been developed to provide a mixing device that is simple to manufacture, durable, and can be used in a variety of resins, paints, and/or liquids, and is able to be used in a variety containers.

In one embodiment, there is a mixing device for mixing resins and other liquids. The mixing device may include a first elongated member. The first elongated member may include a drill end being adaptable to a conventional drill motor chuck and a first connection end. A U-shaped member may be coupled to the first elongated member. The U-shaped member may include a first end, coupled to the first connection end, and a second end. The U-shaped member may curve greater than about 180 degrees; and be coupled to a second elongated member at the second end. The second elongated member may include a second connection end coupled to the second end and/or a free end portion. The free end portion may extend adjacent to and/or substantially parallel to the first elongated member.

In another embodiment, the free end portion wherein the U-shaped member is balanced about an axis of rotation of the first elongated member. In yet another embodiment the first elongated member, the U-shaped member, and/or the second elongated member are contiguous. In being contiguous, the first elongated member, the U-shaped member, and/or the second elongated member are all one piece and not coupled to each other.

In another embodiment, the first elongated member, U-shaped member, and/or the second elongated member are formed of a rigid material. That rigid material may include steel, a ceramic material, and/or a plastic material.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
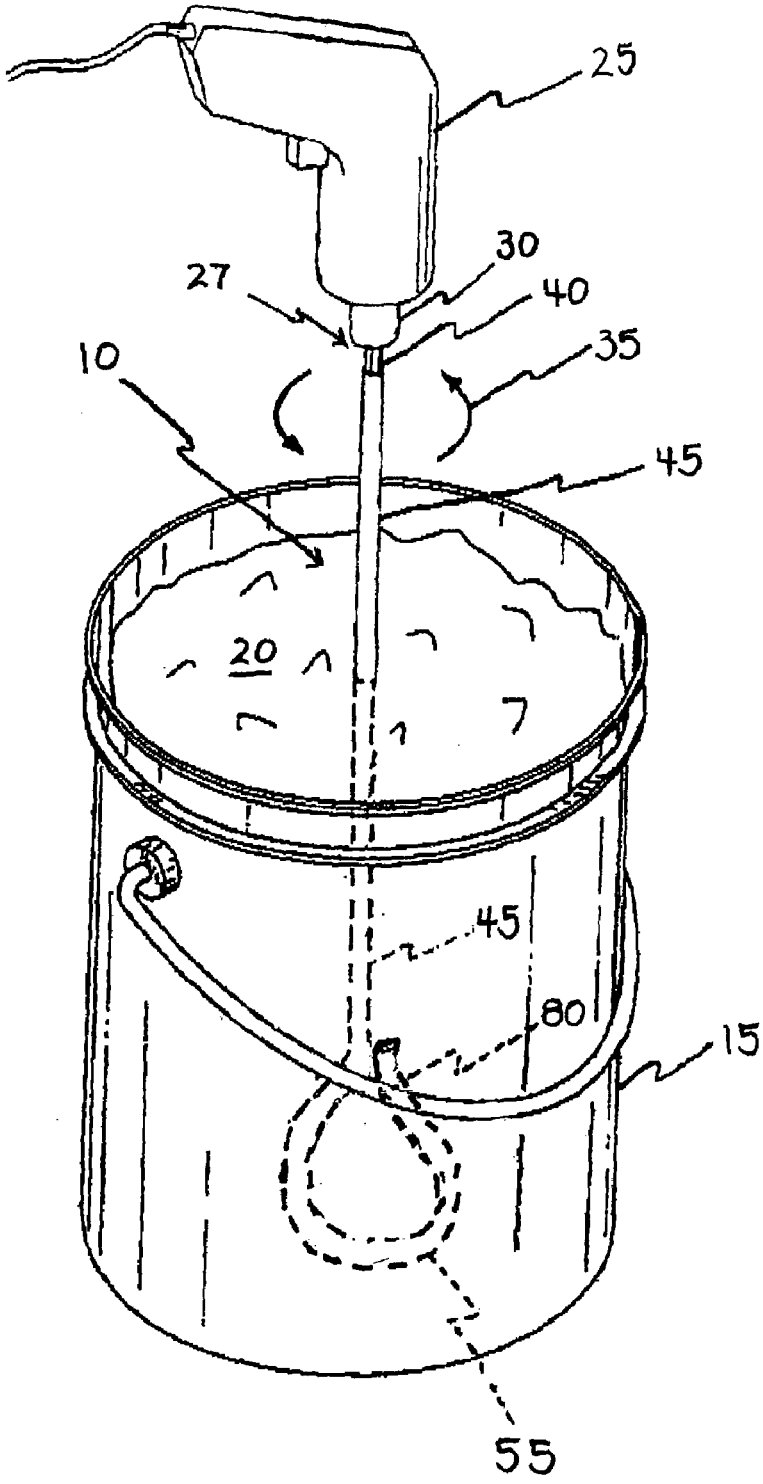
FIG. 1 illustrates a perspective side view of a mixing device, according to one embodiment of the invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

Referring now to the drawings, FIG. 1 illustrates a mixing device 10 inside a container 15 filled with a viscous liquid 20. The simple and compact shape of the mixing device 10 enables the mixing device 10 to be used to mix liquids 20 in variety types and sizes of containers. Some non-limiting examples of containers include: plastic, steel, paper, plastic, ceramic, and so forth. The mixing device 10 is also capable of mixing a variety of liquids with variety degrees of viscosity. Some non-limiting examples of the liquids include: resins, paints, liquid ceramic materials, water, and/or any other liquids known in the art. The mixing device 10 may be used to stir and/or mix a single type of liquid and/or may be used for mixing multiple liquids together.

Looking to FIG. 1, in another embodiment of the invention, the mixing device 10 is adaptable and may be attached to a spinning motor such as, a conventional drill motor 25 through the drill chuck 30 and/or any type of apparatus understood in the art such that the mixing device 10 is caused to spin and/or rotate such as shown by arrow 35, substantially normal to the drill apparatus 25. The mixing device 10 is also adaptable to any drill speed.

Figure 2:
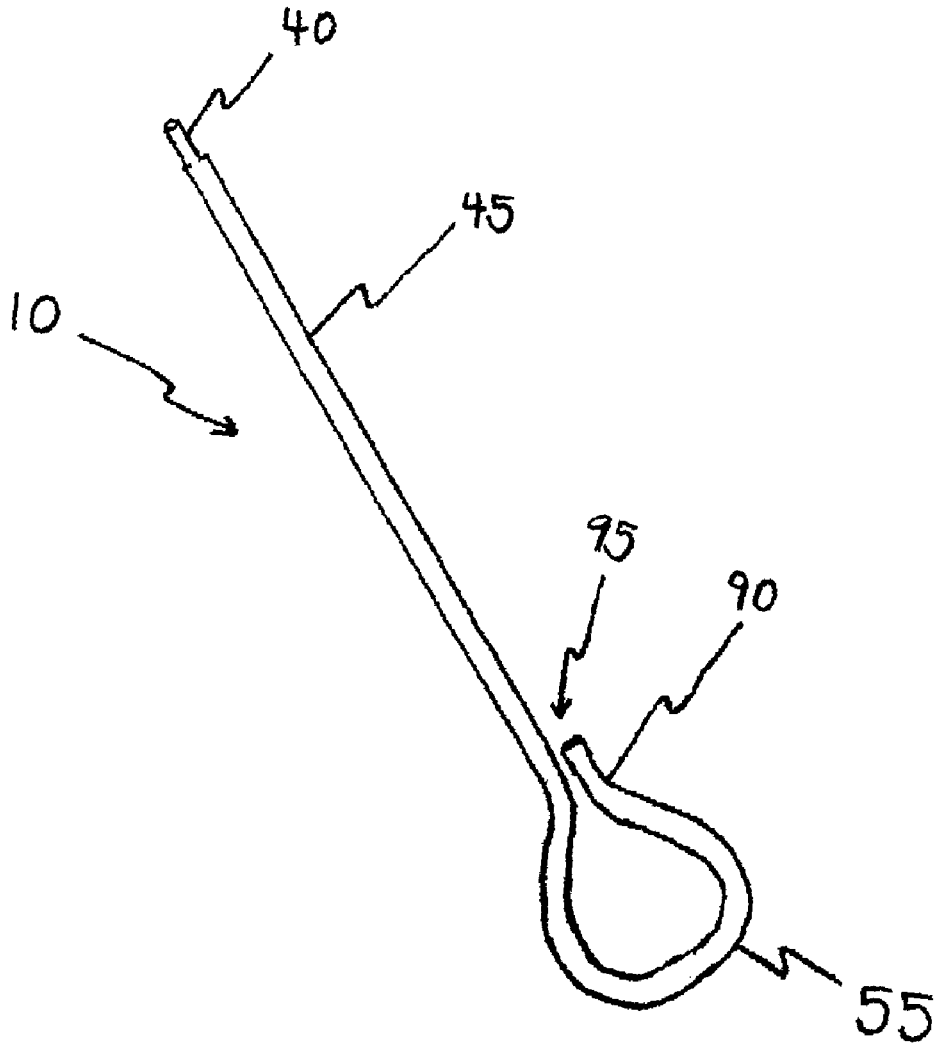
FIG. 2 illustrates a perspective side view of a mixing device, according to one embodiment of the invention.
Figure 3:
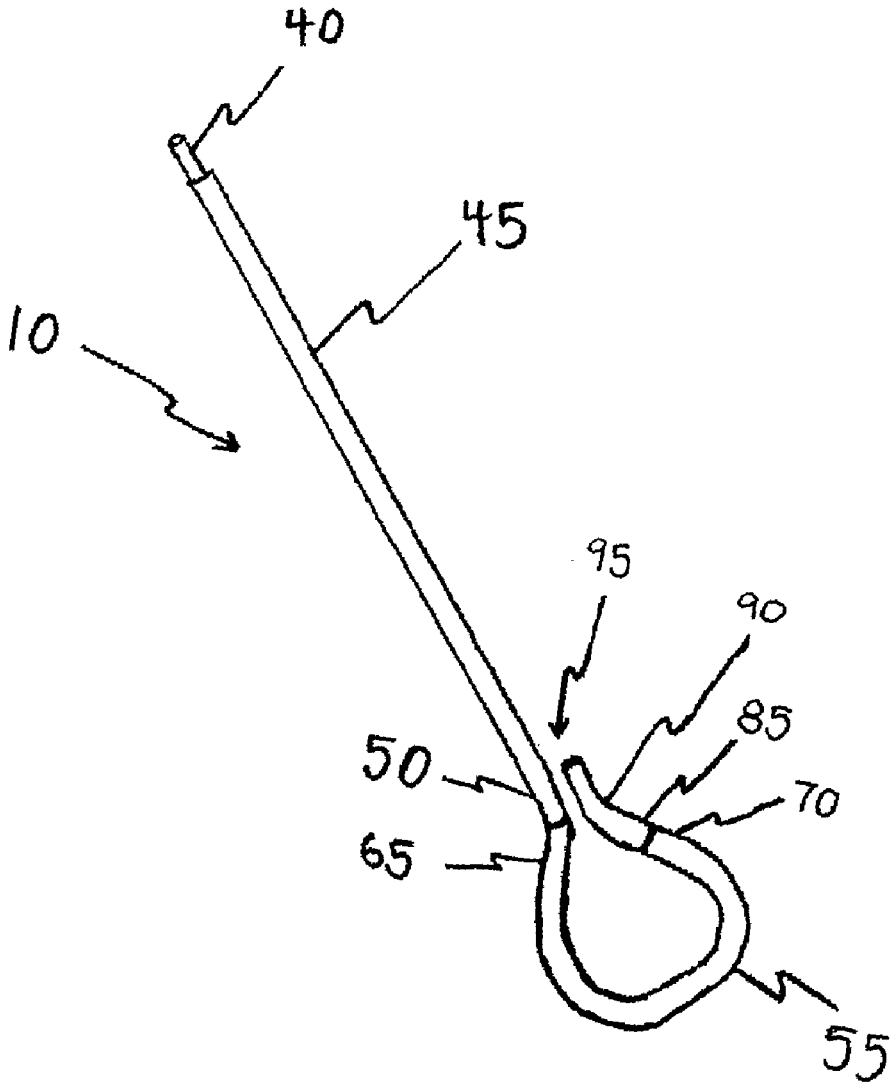
FIG. 3 illustrates a perspective side view of a mixing device, according to one embodiment of the invention.

FIGS. 1-3, in yet another embodiment, shows a mixing device 10 for mixing resins and other liquids consisting essentially of a first elongated member 45 which may include: a drill end 40 being adaptable to a conventional drill motor chuck 30, and a first connection end 50. A U-shaped member 55 may be coupled to the elongated member 45 and may include a first end 65 coupled to the first connection end 50 and a second end 70 wherein the U-shaped member 55 curves greater than about 180 degrees. In curving greater than 180 degrees, the second end 70 curves inward toward the first end 65. The U-shaped member may also be curved greater than 180 degrees such that the second end 70 is in a position normal to that of the first end 65.

Also seen in FIGS. 1-3, a second elongated member 80 coupled to the U-shaped member 55 may include a second connection end 85, coupled to the second end 70, and a free end portion 90. The free end portion 90 may extend adjacent to and substantially parallel 95 to the first elongated member 45, as seen in FIGS. 2 and 3. In extending adjacent to and substantially parallel 95 to the first elongated member; the free end portion 90, together with the U-shaped member 55, form a tear drop shape. This shapes serves to uniformly mix a variety of liquids. The tear drop shape also allows for the size of the liquid container to vary, from thin to wide and/or small to large.

In one embodiment, the U-shaped member 55 is balanced about an axis of rotation of the first elongated member 45. This balancing prevents cavitations of the mixing device 10 while in operation. To accomplish this balancing both sides of the U-shaped 55 member must be equilateral, or mirror images of each other.

FIGS. 1 and 2 illustrate one embodiment of the invention wherein the first elongated member 45, the U-shaped member 55, and the second elongated member 90 are contiguous. In being contiguous, the first elongated member 45, the U-shaped member 55, and the second elongated member 90 constitute one single piece, rather than three separate pieces coupled to one another.

Conversely, FIG. 3 illustrates another embodiment of the invention wherein the first elongated member 45, the U-shaped member 55, and the second elongated member 90 do not constitute a single piece. Rather, the first elongated member 45, the U-shaped member 55, and the second elongated member 90 are three distinct pieces coupled together in a continuous manner.

In one embodiment of the invention, the first elongated member 45, the U-shaped member 55, and the second elongated member 90 are all composed of a rigid material. Some non-limiting examples of a rigid material may include: steel, metal, plastic, a ceramic metal, and/or other rigid materials understood in the art. The mixing device 10 may be a continuous cylindrical rod of varying diameters. Some non-limiting diameters include: ½ inch, ⅜ inch, 3/16 inch, and so forth.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

Additionally, although the figures illustrate the mixing device 10 as an elongated cylindrical object, the mixing device me be formed from a plurality of elongated shapes or tubular shapes. Some non-limiting examples include: rectangular, triangular, and/or so forth.

It is also envisioned that mixing device 10 may be varying lengths and/or sizes. For example, the U-shaped member 55 may curve up to 360 degrees to form a circular shape with varying diameters and lengths. The tear drop shape formed from the greater than 180 degree curvature of the U-shaped member 55 could also have varying diameters and lengths.

Finally, it is envisioned that the components of the mixing device 10 may be constructed of a variety of materials. Some non-limiting examples include: steel, plastic, ceramic materials, and/or so forth.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A mixing device for mixing resins and other liquids, consisting essentially of:

a first elongated member including:

a drill end being adaptable to a conventional drill motor chuck; and a first connection end;

a U-shaped member coupled to the elongated member, including:

a first end coupled to the first connection end; and a second end;

wherein the U-shaped member curves greater than about 180 degrees; and a second elongated member coupled to the U-shaped member, including:

a second connection end coupled to the second end; and a free end portion;

wherein the free end portion extends adjacent to and substantially parallel to the first elongated member.

2. The mixing device of claim 1, wherein the first elongated member, the U-shaped member, and the second elongated member are contiguous.

3. The mixing device of claim 1, wherein the U-shaped member is balanced about an axis of rotation of the first elongated member.

4. The mixing device of claim 1, wherein the free end portion does not transverse the first elongated member.

5. The mixing device in claim 1, wherein the first elongated member, U-shaped member, and the second elongated member is formed of a rigid material.

6. The mixing device of claim 5, wherein the rigid material includes steel.

7. The mixing device of claim 5, wherein the rigid material includes a ceramic material.

8. The mixing device of claim 5, wherein the rigid material includes a plastic material.

9. The mixing device of claim 1, wherein the first elongated member, U-shaped member, and the second elongated member are a continuous cylindrical rod.

10. The mixing device of claim 9, wherein the diameter of the continuous rod is 3/16 inches.

11. The mixing device of claim 9, wherein the diameter of the continuous rod is ⅜ inches.

* * * * *